US005495662A

United States Patent [19]

Nitta et al.

[11] Patent Number: 5,495,662

[45] Date of Patent: Mar. 5, 1996

[54] CABLE GUIDE FOR A TERMINAL CRIMPING APPARATUS

[75] Inventors: Yoshio Nitta; Sadahiko Hachino, both of Kanazawa, Japan

[73] Assignee: Sumitomo Wiring Systems, Ltd., Mie, Japan

[21] Appl. No.: 190,845

[22] Filed: Feb. 3, 1994

[30] Foreign Application Priority Data

Feb. 9, 1993 [JP] Japan ..... 5-045905

[51] Int. Cl.[6] ..... H01R 43/04

[52] U.S. Cl. ..... 29/753; 29/759; 29/760

[58] Field of Search ..... 29/753, 751, 759, 29/760

[56] References Cited

U.S. PATENT DOCUMENTS

| | | | |
|---|---|---|---|
| 3,693,230 | 9/1972 | Morgan . | |
| 3,707,756 | 1/1973 | Wolyn | 29/759 X |
| 3,710,483 | 1/1973 | Morgan et al. . | |
| 3,771,208 | 11/1973 | Taylor et al. | 29/753 X |
| 4,064,624 | 12/1977 | Spangler . | |
| 4,516,309 | 5/1985 | Clark | 29/753 X |
| 5,025,549 | 6/1991 | Hornung et al. . | |
| 5,058,260 | 10/1991 | Gloe et al. . | |

FOREIGN PATENT DOCUMENTS

| | | |
|---|---|---|
| 60-32316 | 7/1985 | Japan . |
| 60-32314 | 7/1985 | Japan . |
| 60-32315 | 7/1985 | Japan . |
| 2257067 | 1/1993 | United Kingdom . |

*Primary Examiner*—Carl E. Hall
*Attorney, Agent, or Firm*—Oliff & Berridge

[57] ABSTRACT

A cable guide for a terminal crimping apparatus includes a guide member held between support plates in a clamped state such that one end of the guide member is turnably supported while the other end of the guide member is normally biased in the upward direction by the resilient force of a coil spring. A cable is inserted through a nozzle and a slit formed through the fore end part of a restricting piece. As an arm is turned, the nozzle and the restricting piece are displaced toward a cable guide together with the arm. Thus, the cable is displaced to an optimum cable feeding position relative to an applicator while slidably moving along the upper surface of the guide member. Since the plate-shaped guide member serves to properly guide the displacement of the cable, the terminal is always securely crimped and the cable is prevented from being undesirably deformed.

11 Claims, 6 Drawing Sheets

CABLE GUIDE FOR A TERMINAL CRIMPING APPARATUS

BACKGROUND OF THE INVENTION

The present invention relates to a cable guide, and more particularly to a cable guide that is usable for feeding a cable to a predetermined position when a terminal is crimped on the cable by operating a terminal crimping apparatus including an applicator.

When a terminal is crimped on a cable, a series of steps is performed including cutting the cable to have a predetermined length, peeling a sheath layer of the cable at the foremost end part of the cable from a cable conductor, crimping the terminal on the cable and feeding the cable by a predetermined distance. Usually, two sets of terminal crimping devices are used for connecting the foremost end of a cable to a terminal on the rear end side of the cable. When it is assumed that the direction of feeding a cable is referred to as a forward direction, an apparatus for crimping a terminal to the fore end part of a cable is called a number one apparatus and an apparatus for crimping a terminal to the rear end part of a cable is called a number two apparatus During a terminal crimping step, a cable is transferred to a predetermined cable feed position on an applicator, and subsequently, a terminal is crimped on the cable while the cable is held at the foregoing cable feed position. To reliably hold the cable at the cable feed position, a cable guide is used. FIG. 9 shows by way of front view the structure of a conventional cable guide including an end feed type applicator.

Referring to FIG. 9, a cable guide 1 is composed of a substantially T-shaped support base plate 2 made of a metallic plate and a guide wire 3 made of a piano wire in an arc-shaped bent state while extending in the horizontal direction with one end thereof turnably fixed at the right-hand end of the base plate 2. The guide wire 3 is formed in the upward arched contour and includes a recess 3*a* at a central position. The recess 3*a* serves to retain a cable at the central position of the cable guide 1.

FIG. 10(*a*)–(*c*) schematically show how a cable 4 is fed to the guide wire 3, respectively, wherein FIG. 10(*a*) shows that the cable 4 is correctly fed to the guide wire 3, and FIG. 10(*b*) and FIG. 10(*c*) show that the cable 4 is incorrectly fed to the guide wire 3.

As the cable 4 is discharged from a nozzle 5, it is projected by a predetermined length as measured from the foremost end of the nozzle 5. During the cable feeding step, the nozzle 5 approaches the cable guide 1 from the right-hand side of the cable guide and stops in front of the recess 3*a*. On completion of a terminal crimping operation, the nozzle 5 returns in the rightward direction. At this time, as the cable 4 approaches the guide wire 3 from the right-hand side of the cable guide 1, it comes in slantwise contact with the guide wire 3 from above and slidably moves along the guide wire 3 until it is received in the recess 3*a* and stops while it is held in the recess 3*a*. When a terminal is crimped by an applicator, the cable 4 is depressed by-the applicator by a very short distance, causing the guide wire 3 to be depressed. After completion of the crimping operation, when the guide wire 3 is resiliently restored to the original position, i.e., the original height, and the nozzle 5 starts to move in the rightward direction, the cable 4 received in the recess 3*a* slidably leaves the recess 3*a* while slightly bending the guide wire 3 so that the cable 4 is transferred to a next step.

In addition, FIG. 11 shows the structure of another conventional cable guide including a side feed type applicator. A guide wire 6 made of a piano wire bent in an arched contour is fixedly held on a support plate 7, whereby a cable 4 can be slidably fed to a predetermined position with the aid of the piano wire 6.

Each of the conventional cable guides constructed in the above-described manner, however, has the following problems.

When a certain force is applied to the guide wire made of a piano wire in a certain direction, the guide wire is resiliently deflected, and the deflection of the guide wire is absorbed by the resilient deformation of the piano wire. However, as the piano wire is repeatedly deflected, it is gradually permanently deformed. Thus, there arises a necessity for adjusting the present deflected state of the piano wire. In the case that a terminal is incorrectly crimped on a cable, causing the cable to be entangled in the terminal, when a certain high intensity power is applied to the guide wire in such a manner as to allow the guide wire to be forcibly displaced, there arises an occasion that the guide wire is undesirably deformed. Another problem is such that it is necessary that the guide wire is adjusted every time the applicator is changed.

Once the guide wire is permanently deformed, the cable cannot be fed to a correct position. Thus, there often arises a malfunction that a terminal is incorrectly crimped on a cable.

SUMMARY OF THE INVENTION

The present invention has been made in consideration of the foregoing problems and an object of the invention is to provide a cable guide for a terminal crimping apparatus that assures that durability of the cable guide can be improved, a maintenance service can easily be achieved, and moreover, malfunctions arising from a terminal being incorrectly crimped on a cable can be prevented.

According to one aspect of the present invention, there is provided a cable guide for a terminal crimping apparatus operable for feeding a cable to a predetermined feeding position relative to an applicator, wherein the cable guide includes a rigid guide member serving to guide the displacement of the cable to the predetermined feeding position relative to the applicator within the range of a displacement path for the cable; a holding mechanism for resiliently holding the guide member to allow the cable to be displaced from the predetermined feeding position toward a caulking die of the applicator by a predetermined distance; and a restricting piece disposed between the guide member and the applicator preventing the cable from being displaced in the opposite direction to that of the turnable displacement of the hand.

In addition, according to another aspect of the present invention, there is provided a cable guide for a terminal crimping apparatus for feeding a cable to a cable feeding position relative to an applicator in a certain one direction by displacing the cable to the cable feeding position, the cable guide serving to hold the cable in the clamped state at the cable feeding position with the aid of a pair of position determining arms while the cable is oriented in the foregoing one direction, wherein the cable guide includes a rigid guide member serving to guide the displacement of the cable to a predetermined feeding position relative to the applicator within the range of a displacement path of the cable extending along the upper surface of the guide member; and a holding mechanism for resiliently holding the guide member to allow the cable to be displaced from the predetermined feeding position toward a caulking die of the applicator by a predetermined distance.

According to another aspect of the invention, a cable guide for a terminal crimping apparatus is provided for feeding a cable to a predetermined feeding position relative to an applicator, the cable guide including a rigid guide member pivotally disposed adjacent the applicator, the guide member guiding the cable to the predetermined feeding position; and a restricting piece disposed between the guide member and the applicator, the restricting piece receiving the cable and preventing the cable from being deflected away from the predetermined feeding position.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

The present invention will now be described in detail hereinafter with reference to the accompanying drawings, which illustrate preferred embodiments thereof.

Figure 1:
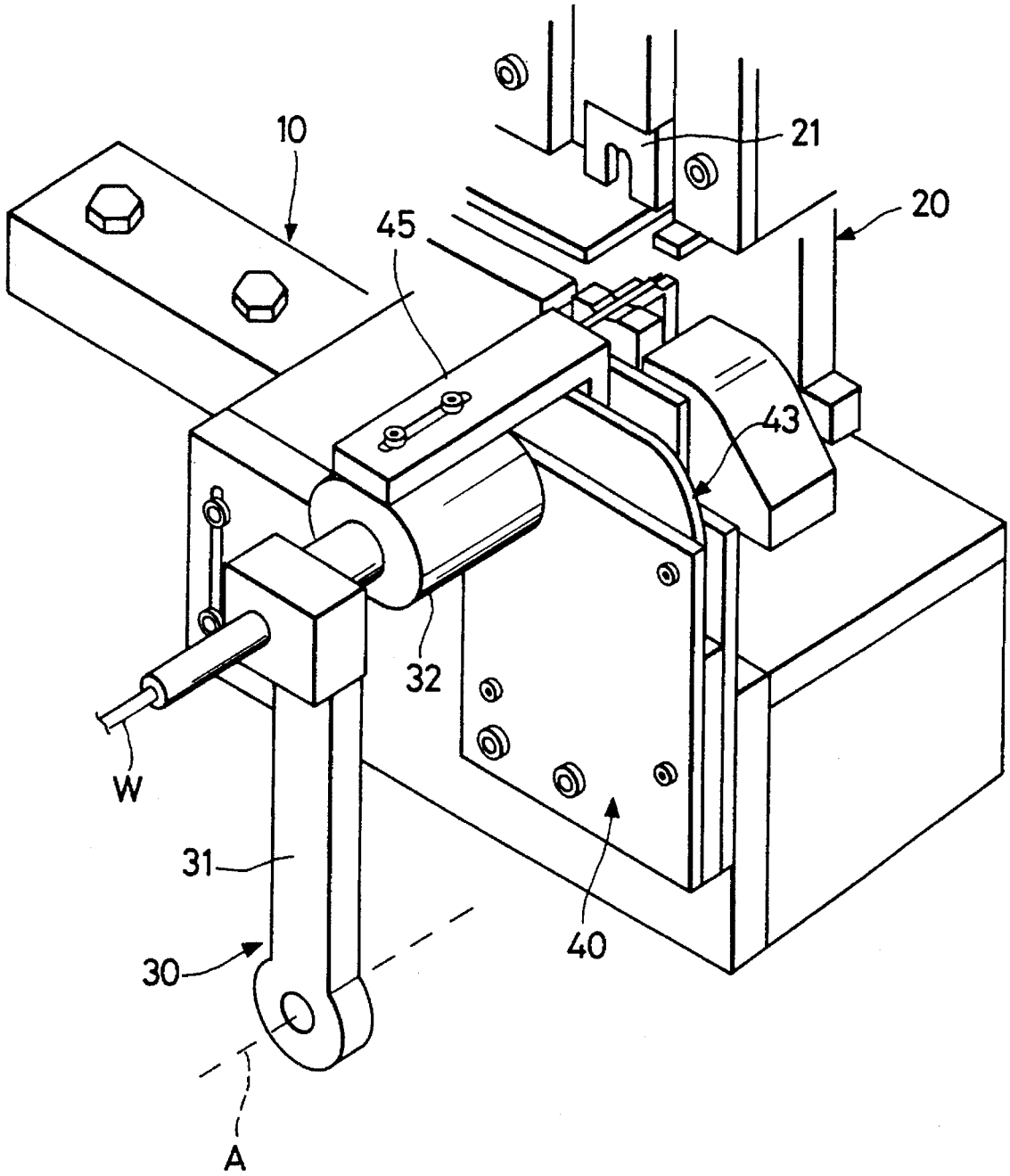
FIG. 1 is a fragmentary perspective view of a terminal crimping apparatus for which a cable guide constructed according to an embodiment of the present invention is employed.

FIG. 1 shows by way of fragmentary perspective view the structure of a terminal crimping apparatus for which a cable guide constructed according to an embodiment of the present invention is employed. The terminal crimping apparatus shown in the drawing serves as a so-called number one apparatus.

Referring to FIG. 1, a terminal crimping apparatus 10 is exchangeably equipped with a side feed type applicator 20. An arm 31 of a cable feeding mechanism 30 is disposed in front of the applicator 20. While a cable W is inserted through a nozzle 32 disposed at the foremost end of the arm 31, the arm 31 is turnably driven about an axis A by a motor (not shown) or the like to assume a horizontal attitude or a vertical attitude. While the arm 31 is held in the horizontal state, the cable W is cut to have a predetermined length, and a sheath layer of the cable W is removed from a cable conductor in a known manner, and subsequently, while the arm 31 is held in the vertical state, the cable W is fed to the applicator 20 in which a terminal is crimped on the cable W. After completion of a crimping operation, the arm 31 is turned to assume the horizontal attitude, and thereafter, the cable W is delivered to the arm 31 so as to repeatedly execute a cutting step. It should be noted that a so-called hand is constructed by the arm 31 and the nozzle 32.

Figure 2:
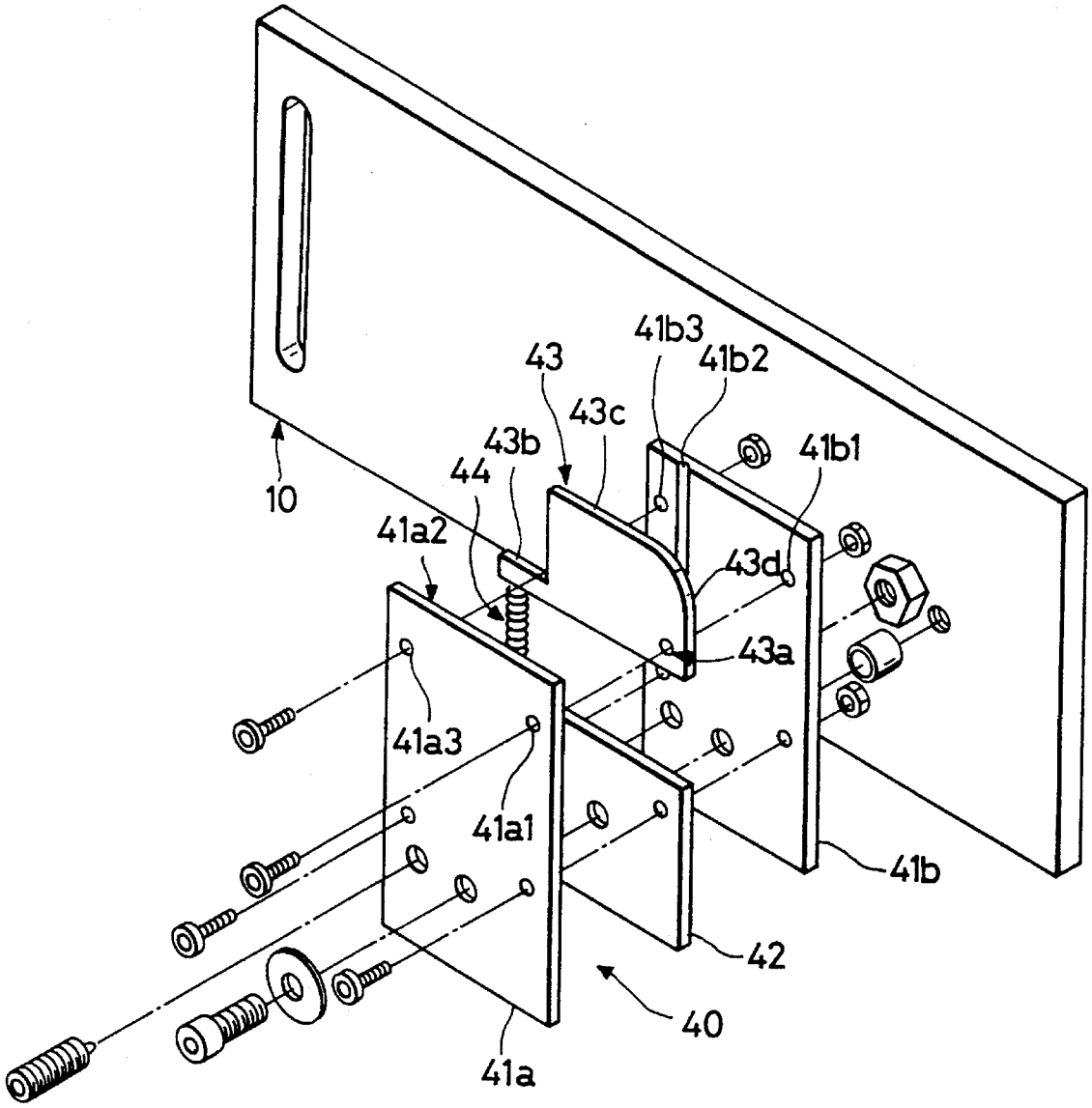
FIG. 2 is a perspective view of the cable guide, particularly showing essential components constituting the cable guide in the disassembled state.

A cable guide 40 is disposed between the applicator 20 and the cable feeding mechanism 30 and is fixedly secured to the terminal crimping apparatus 10. As shown in FIG. 2, the cable guide 40 includes support plates 41*a* and 41*b* each made of a rectangular plate material, and a spacer 42 and a guide member 43 are interposed between the support plates 41*a* and 41*b*. The spacer 42 is dimensioned to have a thickness larger than that of the guide member 43, and it is disposed in a lower half of the space between the support plates 41*a* and 41*b*. A rotation hole 43*a* is formed through the guide member 43 at a position on the lower right-hand side of the guide member 43 and is positionally aligned with rotation holes 41*a*1 and 41*b*1 formed through both the support plates 41*a* and 41*b* at the upper end positions on the right-hand side of the support plates 41*a* and 41*b* so as to allow a screw to be inserted through the rotation holes 41*a*1, 43*a* and 41*b*1. At this time, the guide member 43 is held between the support plates 41*a* and 41*b* in a clamped state such that it can be turned about the rotation hole 43*a*. An engagement piece 43*b* is horizontally projected from the lower end part of the guide member 43 on the left-hand side of the guide member 43, and the engagement piece 43*b* is normally biased in the upward direction by the resilient force of a coil spring 44 received in concave grooves 41*a*2 and 41*b*2 on the inner wall surfaces of the support plates 41*a* and 41*b* until it collides against the lower surface of a screw inserted through rotation holes 41a3 and 41*b*3 formed through both the support plates 41*a* and 41*b* at the upper left-hand side of the support plates. In addition, the upper right-hand part of the guide member 43 is rounded with a certain radius of curvature so that a horizontal portion 43*c* and an arch-shaped portion 43*d* are formed along the upper surface of the guide member 43.

Figure 3:
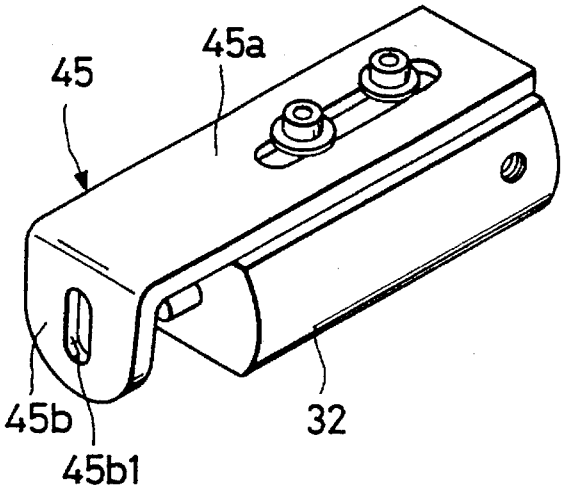
FIG. 3 is a perspective view of a restricting piece and a nozzle constituting the cable guide.

As shown in FIG. 3, a restricting piece 45 having an L-shaped sectional contour is fixedly secured to the upper surface of the nozzle 32 by tightening two screws. The restricting piece 45 is composed of a horizontal portion 45*a* fixed to the upper surface of the nozzle 32 and a vertical portion 45*b* downwardly bent on the applicator 20 side at a right angle relative to the horizontal portion 45*a*, and a slit 45*b*1 is formed through the vertical portion 45*b* such that it is oriented in the vertical direction when the arm 31 is turned to assume a vertical attitude. The slit 45*b*1 is wide enough to allow the cable W to be inserted therethrough. As shown in FIG. 1, when the cable guide 40 is assembled with the terminal crimping apparatus 10, the vertical portion 45*b* of the restricting piece 45 extends over the guide member 43 to assume a position in the vicinity of the applicator 20.

Next, a mode of operation of the cable guide 40 constructed in the aforementioned manner will be described below.

A cable W is inserted through the nozzle 32, and when the arm 31 is turned to assume a horizontal attitude, the cable W is cut at the foremost end thereof, and a sheath layer of the cable W is removed from a cable conductor in a known manner. As the arm 31 is turned to assume a vertical attitude, it approaches the applicator 20 together with the nozzle 32. As the nozzle 32 comes near to the cable guide 40, the guide member 43 of the cable guide 40 assumes a position between the nozzle 32 and the vertical portion 45*b* of the restricting piece 45. At this time, since the cable W held between the nozzle 32 and the vertical portion 45*b* of the restricting piece 45 comes in contact with the arch-shaped portion 43*d* of the guide member 43, the cable W is deflected in the leftward/rightward direction. However, since the foremost end part of the cable W extends through the slits 45*b*1 of the vertical portion 45*b* of the restricting piece 45, the cable W cannot be further deflected in the leftward/rightward direction, and it is displaced in the slit 45*b*1 in the upward direction while coming in slidable contact with the arch-shaped portion 43*d* of the guide member 43.

Figure 4:
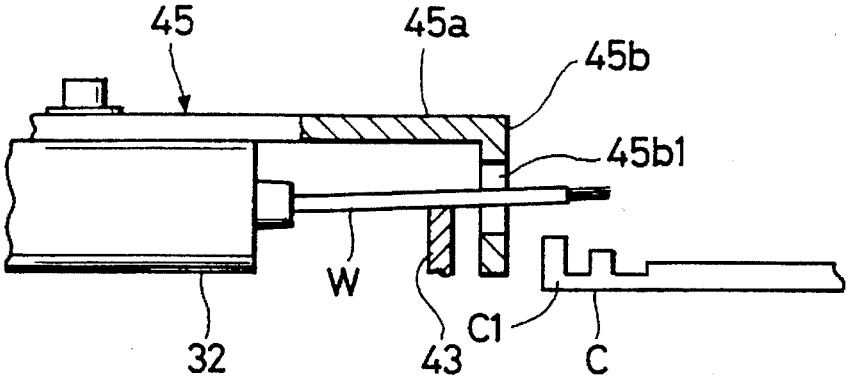
FIG. 4 is a partially sectioned side view of the nozzle.
Figure 5:
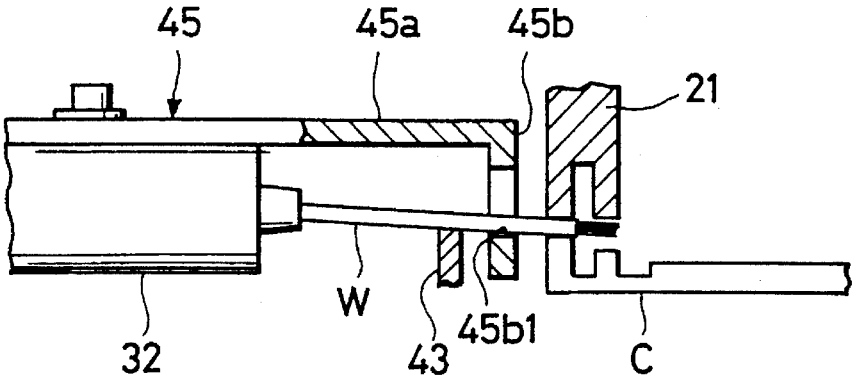
FIG. 5 is a partially sectioned side view of the nozzle.

As the arm 31 is turned farther, the cable W is brought in slidable contact with the horizontal portion 43*c* of the guide member 43 until it is displaced to a predetermined position. This positional state is shown in FIG. 4, and the cable W is slightly bent in the slantwise upward direction while coming in contact with the upper surface of the guide member 43. While the foregoing state is maintained, the cable W can be displaced in the horizontal direction without any contact with a barrel C1 of a terminal C. Subsequently, as a crimper 21 of the applicator 20 (serving as a caulking die) is lowered from above, it comes in contact with the cable W to depress the cable therewith as shown in FIG. 5. At this time, a part of the power for depressing the cable W is applied to the guide member 43, causing the guide member 43 to be turned about the rotation hole 43*a* in the downward direction against the resilient force of the coil spring 44. Thus, the cable W is received in the barrel C1 of the terminal C without any excessive bending thereof, and thereafter, the terminal C is crimped by the crimper 21. When the crimper 21 is upwardly returned to the original position after completion of the crimping operation, the guide member 43 is likewise returned to the original position by the resilient force of the coil spring 44, causing the cable W having the terminal C crimped thereon to be raised up by the guide member 43. Subsequently, when the arm 31 is turnably returned to assume the horizontal attitude, the cable W is slidably displaced from the horizontal portion 43*c* to the arch-shaped portion 43*d*, whereby the cable W is parted away from the guide member 43.

As described above, the cable guide 40 serves to guide the slidable displacement of the cable W to a predetermined position on the applicator 20. Specifically, in this embodiment, the plate-shaped guide member 43 serves to guide the displacement of the cable W along a predetermined supply path without any possibility that it is bent like a piano wire. Consequently, the durability of the cable guide 40 can be improved, and moreover, each maintenance service can easily be performed.

With the cable guide thus defined, the cable is held with the aid of the hand. In addition, the cable is held with the aid of a restricting piece disposed ahead of the hand without any possibility that it is bent in the direction of displacement of the cable. As the cable is fed toward the applicator, the displacement of the cable along the upper surface of the guide member toward the predetermined feeding position relative to the applicator is guided by the guide member. Since the guide member is constructed of a hard member, there does not arise a malfunction that the guide member is undesirably deformed. The guide member is resiliently held by the holding mechanism. When the caulking die of the applicator is actuated to squeeze the cable therewith, the hand is displaced together with the cable in the forward direction, resulting the power applied to the cable being attenuated. When the caulking die is restored to the original position after completion of a crimping operation, the guide member is likewise restored to the original position by the holding mechanism. Subsequently, the cable having a connector crimped thereon is delivered to a subsequent step, and the cable guide is held in the waiting state to receive a new cable to be fed to the terminal crimping apparatus.

Figure 6:
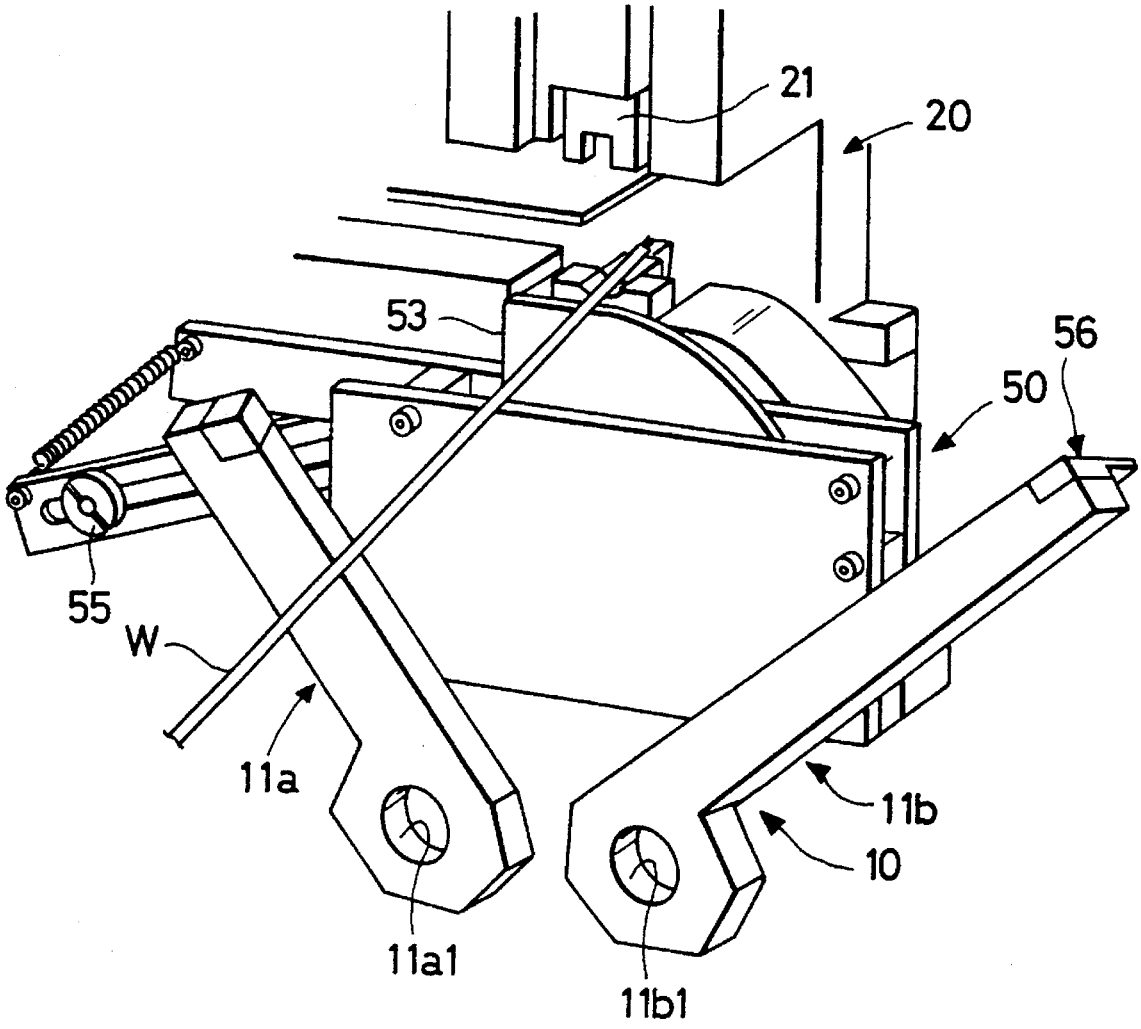
FIG. 6 is a fragmentary perspective view of a terminal crimping apparatus for which a cable guide constructed according to another embodiment of the present invention is employed.

FIG. 6 shows by way of a fragmentary perspective view the structure of a terminal crimping apparatus for which a cable guide constructed according to another embodiment of the present invention is employed. The terminal crimping apparatus shown in the drawing serves as a so-called number two apparatus.

Referring to FIG. 6, the terminal crimping apparatus 10 includes two position determining arms 11*a* and 11*b*. The position determining arms 11*a* and 11*b* are simultaneously turned away from each other in opposite directions with rotation axes 11*a*1 and 11*b*1 as fulcrums. In other words, both the position determining arms 11*a* and 11*b* simultaneously perform a turnable opening/closing operation.

Figure 7:
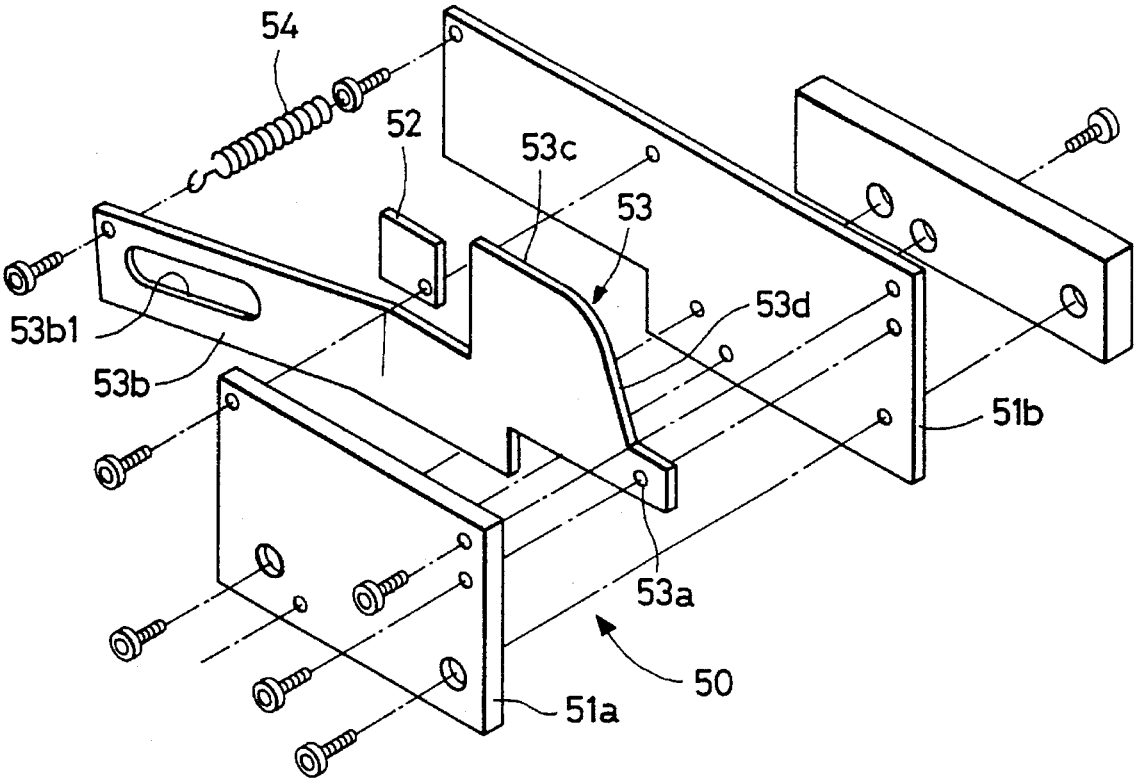
FIG. 7 is a perspective view of the cable guide, particularly showing essential components constituting the cable guide in the disassembled state.

As shown in FIG. 7, a cable guide 50 includes a guide member 53 from which an elongated engagement piece 53*b* is projected in the leftward direction, and a spacer 52 is held above the engagement piece 53*b*. The spacer 52 serves to restrict the turning movement of the guide member 53, and moreover, to hold support plates 51*a* and 51*b* in a spaced relationship so as to allow the guide member 53 to be easily turned. The left-hand part of the support plate 51*b* is projected on the applicator 20 side in the same manner as the engagement piece 53*b*, and a coil spring 54 is resiliently bridged between the rearmost ends of the support plate 51*b* and the engagement piece 53*b*. An elongated hole 53*b* 1 is formed through the engagement piece 53*b*. As shown in FIG. 6, a circular cam 55 is fixedly fitted into the elongated hole 53*b* 1 at a predetermined position. When the position determining arms 11*a* and 11*b* are turnably opened away from each other, the cam 55 comes in contact with the position determining arm 11*a*, causing the engagement piece 53*b* to be turnably depressed by the position determining arm 11*a* via the cam 55.

Figure 8:
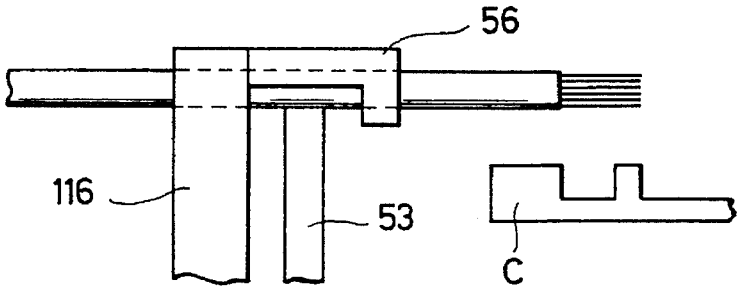
FIG. 8 is a fragmentary side view of the terminal crimping apparatus, particularly showing how a second arm is fixedly secured to a position determining lever.
Figure 9:
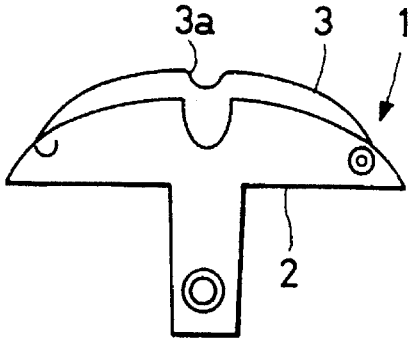
FIG. 9 RELATED ART
FIG. 9 is a front view of a conventional cable guide.
Figure 10:
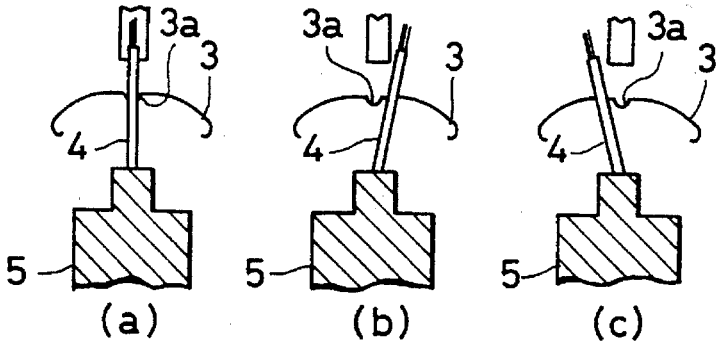
FIG. 10 RELATED ART
FIG. 10 shows illustrative views, each of which schematically shows the relationship between a cable and the cable guide.
Figure 11:
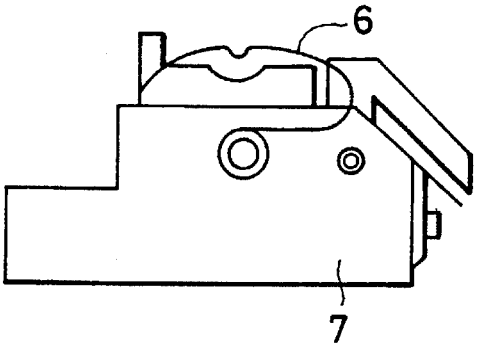
FIG. 11 RELATED ART
FIG. 11 is a front view of another conventional cable guide.

As shown in FIG. 8, a second arm 56 is fixedly secured to the outermost end of the position determining arm 11*b* by tightening screws in such a manner that the foremost end of the second arm 56 extends toward the applicator 20 side in excess of the guide member 53 to come near to a terminal C.

With the number two apparatus constructed in the above-described manner, a handle (not shown) is turned in front of the applicator 20 at the same time as a crimping step is executed. While the fore end part of a cable W having a sheath layer removed from a cable conductor is held by the handle, the cable W is fed to the applicator 20 in substantially the horizontal direction.

In the beginning, the position determining arms 11*a* and 11*b* are turnably opened away from each other, and subsequently, the handle having the cable W held thereby is displaced in front of the applicator 20. At this time, the cable W is brought in slantwise contact with an arc-shaped portion 53*d* of the engagement piece 53*b*, and thereafter, it is displaced to a horizontal portion 53*c* of the engagement piece 53*b* after it is slidably displaced along the arc-shaped portion 53*d*. Then, the position determining arms 11*a* and 11*b* start to be simultaneously closed toward each other. On completion of the closing operation, the cable W is clamped between the foremost end parts of the position determining arms 11*a* and 11*b* so that it is held at the central position by both the position determining arms 11*a* and 11*b* without any positional offset relative to the applicator 20 in the leftward/rightward direction. At this time, since the second arm 56 holds the cable W at the position on the applicator 20 side in excess of the guide member 53, the cable W can more exactly be located at the central position. Since the position determining arm 11*a* is parted away from the cam 55 on the engagement piece 53 as it is turnably closed, the guide member 53 is slightly turned in the clockwise direction, causing the cable W to be raised up by the guide member 53.

As a crimper 21 is lowered, it comes in contact with the foremost end part of the cable W so as to depress the cable W therewith. At the same time, the guide member 53 is turnably lowered, whereby a terminal is crimped on the cable W by the crimper 21 and is squeezed against the cable W at an adequate angle relative to the cable. When-the crimper 21 is raised up after completion of the crimping operation, the position determining arms 11*a* and 11*b* are simultaneously turnably opened away from each other. At this time, the position determining arm 11*a* comes in contact with the cam 55, causing the engagement piece 53*b* to be turnably depressed by the position determining arm 11*a* via the cam 55. Thus, the upper surface of the guide member 53 is lowered. Subsequently, since the handle is turned, the cable W is fed without a possibility of being entangled with associated components.

With the cable guide thus defined, since the cable is held at the cable feeding position in the clamped state in the direction of displacement of the cable by an opposing pair of position determining arms, there does not arise a malfunction that the cable is dislocated from the cable feeding position. Since the guide member is vertically turnably held by the holding mechanism without any dislocation of the cable from the cable feeding position not only at the time of cable feeding but also at the time of terminal crimping, the cable can correctly be displaced to a predetermined position with the aid of the guide member in the same manner as the cable guide of the first embodiment.

As described above, according to the present invention, since the rigid guide member is resiliently held with the aid of the holding mechanism, durability of the cable guide can be improved compared with the conventional cable guide made of a piano wire. Consequently, the present invention has provided a cable guide for a terminal crimping apparatus that assures that maintenance service is not required, and incorrect terminal crimping is prevented.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A cable guide for a terminal crimping apparatus for feeding a cable to a predetermined feeding position relative to an applicator by turnably displacing and holding said cable-with a hand, said cable guide comprising:

a rigid guide member serving to guide lateral displacement of said cable to said predetermined feeding position relative to said applicator within the range of a displacement path for said cable;

a holding mechanism for resiliently holding said guide member to allow said cable to be displaced from said predetermined feeding position toward a caulking die of said applicator by a predetermined distance; and a restricting piece disposed between said guide member and said applicator preventing said cable from being displaced in a direction opposite to that of the turnable displacement of said hand.

2. A cable guide for a terminal crimping apparatus for feeding a cable to a cable feeding position relative to an applicator in a certain one direction by displacing said cable to said cable feeding position, said cable guide serving to hold said cable in the clamped state at said cable feeding position with a pair of position determining arms while said cable is oriented in said one direction, said cable guide comprising:

a rigid guide member serving to guide lateral displacement of said cable to a predetermined feeding position relative to said applicator within the range of a displacement path of said cable extending along the upper surface of said guide member; and a holding mechanism for resiliently holding said guide member to allow said cable to be displaced from said predetermined feeding position toward a caulking die of said applicator by a predetermined distance.

3. A cable guide for a terminal crimping apparatus for feeding a cable to a predetermined feeding position relative to an applicator, said cable guide comprising:

a rigid guide member pivotally disposed adjacent said applicator, said guide member guiding said cable to said predetermined feeding position; and a restricting piece disposed between said guide member and said applicator, said restricting piece receiving said cable and preventing said cable from being deflected away from said predetermined feeding position.

4. A cable guide according to claim 3 further comprising a first support plate and a second support plate, wherein a spacer is disposed between said first and second support plates, said spacer having a first width, said guide member having a second width narrower than said first width and being disposed between said first and second support plates.

5. A cable guide according to claim 4, further comprising a spring disposed between said guide member and said spacer, said spring urging said guide member toward a cable feed path, wherein a stop member is disposed between said first and second support plates, said stop member preventing said guide member from being urged into said cable feed path.

6. A cable guide according to claim 5, wherein said restricting piece comprises an L-shaped bracket, one side of said bracket having an aperture for receiving said cable.

7. A cable guide according to claim 3, wherein said restricting piece comprises an L-shaped bracket, one side of said bracket having an aperture for receiving said cable.

8. A cable guide for a terminal crimping apparatus for feeding a cable to a predetermined feeding position relative to an applicator, said cable guide comprising:

a pair of position determining arms clampingly displaceable between a clamping position and an open position, said position determining arms holding and releasing said cable;

a rigid guide member pivotally disposed adjacent said applicator, said guide member guiding said cable laterally to said predetermined feeding position; and a first support plate and a second support plate, wherein a spacer is disposed between said first and second support plates, said spacer having a first width, said guide member having a second width narrower than said first width and being disposed between said first and second support plates.

9. A cable guide according to claim 8, further comprising a spring disposed between said guide member and said second support plate, said spring urging said guide member toward a cable feed path, wherein said spacer is disposed to prevent said guide member from being urged into said cable feed path.

10. A cable guide according to claim 8, wherein said guide member comprises an elongated aperture receiving a cam, one of said pair of position determining arms engaging said cam in said open position, thereby urging said guide member away from a cable feed path.

11. A cable guide according to claim 10, wherein the other of said pair of position determining arms comprises an arm extension member fixed to an end thereof, said arm extension member preventing said cable from being deflected away from said predetermined feeding position.

* * * * *